US011832726B2

(12) United States Patent
Murphy

(10) Patent No.: US 11,832,726 B2
(45) **Date of Patent: *Dec. 5, 2023**

(54) SEATING UNIT WITH EXTENDABLE FOOTREST

(71) Applicant: Ultra-Mek, Inc., Denton, NC (US)

(72) Inventor: Marcus L. Murphy, Lexington, NC (US)

(73) Assignee: ULTRA-MEK, INC., Denton, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/702,063

(22) Filed: Mar. 23, 2022

(65) Prior Publication Data

US 2022/0378207 A1 Dec. 1, 2022

Related U.S. Application Data

(60) Provisional application No. 63/193,313, filed on May 26, 2021.

(51) Int. Cl.

| | |
|---|---|
| ***A47C 1/034*** | (2006.01) |
| ***A47C 7/50*** | (2006.01) |
| ***A47C 1/0355*** | (2013.01) |

(52) U.S. Cl.

CPC ..... *A47C 1/0355* (2013.01)

(58) Field of Classification Search

CPC ..... A47C 1/03211; A47C 7/506; A47C 1/022; A47C 1/037; A47C 7/5068; A47C 1/03272; A47C 1/034; A47C 1/0342; A47C 3/027; A47C 7/52; A47C 1/03294; A47C 1/0345; A47C 1/0347; A47C 1/0352; A47C 12/02; A47C 16/025; A47C 7/503; A47C 1/0355

See application file for complete search history.

(56) References Cited

U.S. PATENT DOCUMENTS

| | | | | |
|---|---|---|---|---|
| 3,135,548 | A * | 6/1964 | Fletcher | A47C 1/0345 297/89 |
| 4,915,444 | A | 4/1990 | Rogers, Jr. | |
| 6,540,291 | B2 | 4/2003 | Hoffman et al. | |
| 8,714,638 | B2 | 5/2014 | Hoffman et al. | |
| 8,752,890 | B2 | 6/2014 | Murphy et al. | |
| 9,271,574 | B2 * | 3/2016 | Hortig | A47C 1/034 |
| 10,213,020 | B2 * | 2/2019 | Lawson | A47C 1/03294 |
| 10,219,624 | B2 * | 3/2019 | Brandhuber | A47C 1/0355 |
| 10,383,443 | B2 * | 8/2019 | Lawson | A47C 1/032 |
| 10,390,621 | B2 * | 8/2019 | Lawson | A47C 1/124 |
| 10,485,347 | B2 * | 11/2019 | Lawson | A47C 1/0355 |
| 11,528,993 | B2 * | 12/2022 | Crum | A47C 3/027 |

(Continued)

*Primary Examiner* — Shin H Kim

(74) *Attorney, Agent, or Firm* — Myers Bigel, P.A.

(57) ABSTRACT

A seating unit includes: a frame configured to rest on an underlying surface comprising a pair of opposed arms, a seat fixed relative to the arms, and a backrest fixed relative to the arms; a footrest; and a footrest mechanism attached to the footrest and the arms. The footrest mechanism comprises a plurality of pivotally interconnected links configured to move the footrest between a retracted position, in which the footrest is positioned beneath the seat and defines an angle of between about 20 and 40 degrees with the underlying surface, and an extended position, in which the footrest is positioned in front of the seat and is generally horizontally disposed and generally inverted from its disposition in the retracted position.

10 Claims, 12 Drawing Sheets

(56) References Cited

U.S. PATENT DOCUMENTS

| | | | | |
|---|---|---|---|---|
| 2008/0012405 | A1* | 1/2008 | Dewert | A47C 7/006 297/217.3 |
| 2011/0043005 | A1* | 2/2011 | Fischer | A47C 7/5066 297/423.3 |
| 2012/0286557 | A1* | 11/2012 | Hoffman | A47C 1/03211 297/85 M |
| 2013/0175847 | A1* | 7/2013 | Lawson | A61G 5/14 297/85 M |
| 2014/0049078 | A1* | 2/2014 | Hortig | A47C 1/035 297/68 |
| 2014/0292052 | A1* | 10/2014 | Parker | A47C 7/4454 297/354.12 |
| 2014/0333111 | A1* | 11/2014 | Besler | A47C 1/0355 297/423.26 |
| 2018/0242742 | A1* | 8/2018 | Lawson | A47C 1/0355 |
| 2021/0100364 | A1* | 4/2021 | Murphy | A47C 1/03211 |
| 2022/0378207 | A1* | 12/2022 | Murphy | A47C 1/0355 |
| 2023/0010099 | A1* | 1/2023 | Murphy | A47C 1/0355 |

* cited by examiner

SEATING UNIT WITH EXTENDABLE FOOTREST

RELATED APPLICATION

The present application claims priority from and the benefit of U.S. Provisional Patent Application No. 63/193,313, filed May 26, 2021, the disclosure of which is hereby incorporated herein by reference in full.

FIELD OF THE INVENTION

The present invention relates generally to seating units, and more particularly to seating units with reclining capability.

BACKGROUND OF THE INVENTION

Conventionally, a recliner chair will move from an upright position, in which the backrest is generally upright, to one or more reclined positions, in which the backrest pivots to be less upright. The movement of the seating unit between the upright and reclined positions is typically controlled by a pair of synchronized reclining mechanisms that are attached to the seat, backrest and base of the chair. Many recliners will have an extendable footrest that provides support for the occupant's feet in the reclined position.

One particularly popular recliner is the "three-way" recliner, which has two reclined positions: a "TV position", in which the footrest or ottoman of the chair is projected forwardly from the chair while the backrest remains substantially upright; and a "fully reclined position", in which the backrest is less upright (i.e., it has been reclined to a shallower angle relative to the floor). In a "three-way" recliner, the backrest pivots relative to the seat as the chair takes its fully reclined position; this differs from a "two-way" recliner, in which the backrest and seat are rigidly fixed and do not pivot relative to one another as the chair moves to the fully reclined position. Many three-way recliners are constructed such that the backrest and footrest are coupled to one another, such that reclining of the backrest cannot occur unless the footrest is already extended (i.e., the chair is in the TV position). See, e.g., U.S. Pat. No. 4,915,444 to Rogers, Jr., and U.S. Pat. No. 6,540,291 to Hoffman, which illustrate chairs of rather contemporary style with three-way reclining capability.

As chair styles vary, providing reclining capability and/or an extendable footrest can become a challenge, particularly for chairs with smaller frames, off-the floor styles, or low seat heights. In particular, footrest extension can become an issue for some chair styles, as the ability to extend a footrest forwardly can be limited by the amount of space available beneath the seat of the chair. Such space may be limited in off-the-floor styles if the reclining mechanisms are to remain hidden when the chair is in the upright position. Also, space may be limited for a chair with a low seat height or a relatively tall base, such as one having a swivel unit. As such, it may be desirable to provide footrest extension mechanisms that can extend a footrest an adequate distance while still functioning with multiple than styles.

SUMMARY

As a first aspect, embodiments of the invention are directed to a seating unit comprising: a frame configured to rest on an underlying surface comprising a pair of opposed arms, a seat fixed relative to the arms, and a backrest fixed relative to the arms; a footrest; and a footrest mechanism attached to the footrest and the arms. The footrest mechanism comprises a plurality of pivotally interconnected links configured to move the footrest between a retracted position, in which the footrest is positioned beneath the seat and defines an angle of between about 20 and 40 degrees with the underlying surface, and an extended position, in which the footrest is positioned in front of the seat and is generally horizontally disposed and generally inverted from its disposition in the retracted position.

As a second aspect, embodiments of the invention are directed to a seating unit comprising: a frame configured to rest on an underlying surface comprising a pair of opposed arms, a seat fixed relative to the arms, and a backrest fixed relative to the arms; a main footrest; an auxiliary footrest; and a footrest mechanism attached to the main and auxiliary footrests and the arms. The footrest mechanism comprises a plurality of pivotally interconnected links configured to move the main and auxiliary footrests between (a) a retracted position, in which the main footrest is generally vertically disposed just forward of the seat, and the auxiliary footrest is rearward of the main footrest, and (b) an extended position, in which the main and auxiliary footrests are extended in front of the seat and are generally horizontally disposed, with the auxiliary footrest positioned in front of the main footrest.

DETAILED DESCRIPTION OF EMBODIMENTS OF THE INVENTION

Figure 1:
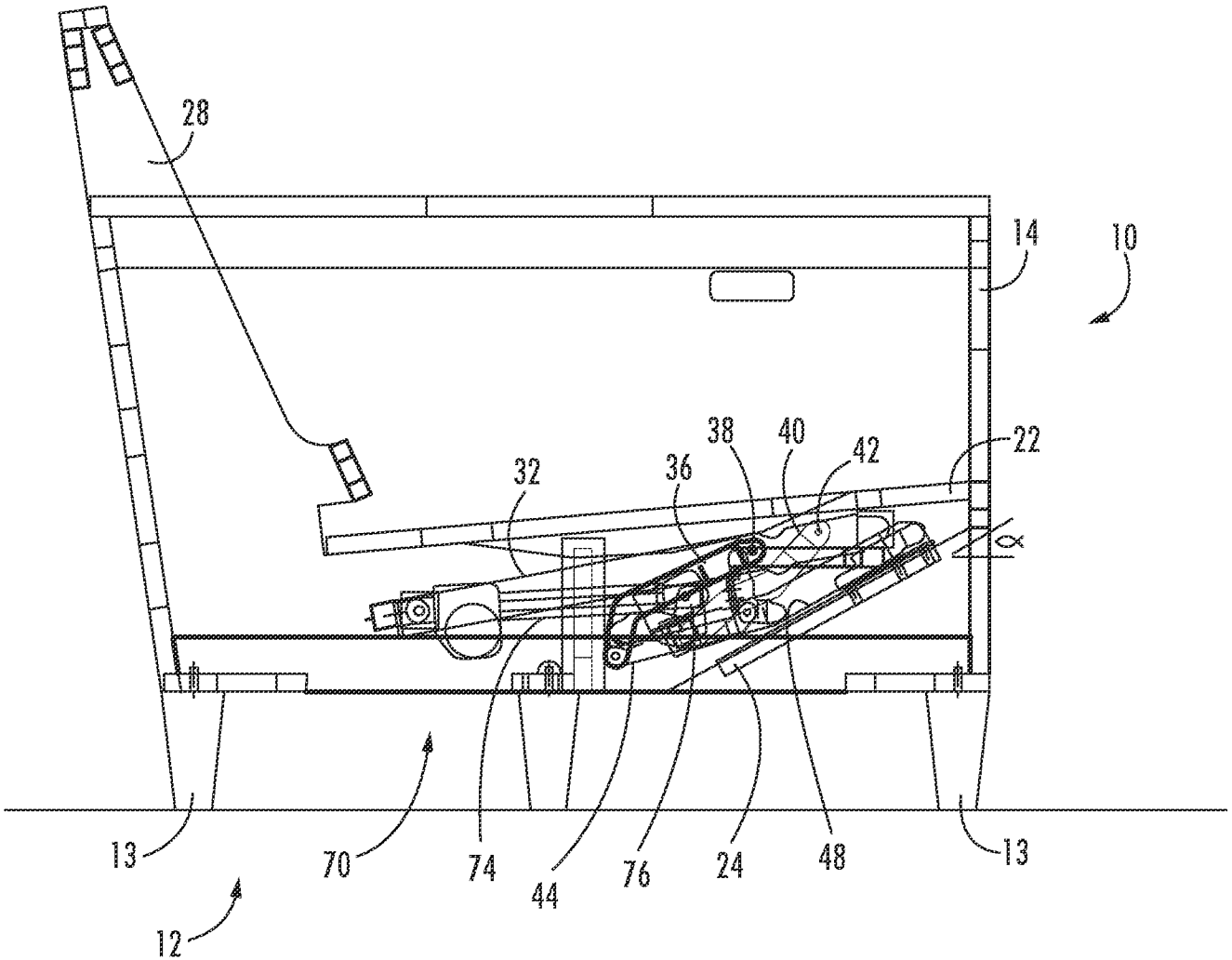
FIG. 1 is a side view of a chair with an extendable footrest according to embodiments of the invention, wherein the footrest is in its retracted position.

The present invention will be described more particularly hereinafter with reference to the accompanying drawings. The invention is not intended to be limited to the illustrated embodiments; rather, these embodiments are intended to fully and completely disclose the invention to those skilled in this art. In the drawings, like numbers refer to like elements throughout. Thicknesses and dimensions of some components may be exaggerated for clarity. Well-known functions or constructions may not be described in detail for brevity and/or clarity.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

Where used, the terms "attached", "connected", "interconnected", "contacting", "coupled", "mounted" and the like can mean either direct or indirect attachment or contact between elements, unless stated otherwise.

In addition, some components of the seating units described herein (particularly mechanisms thereof) are illustrated herein as a series of pivotally interconnected links or members. Those skilled in this art will appreciate that the pivots between links or other components can take a variety of configurations, such as pivot pins, rivets, bolt and nut combinations, and the like, any of which may be suitable for use with the present invention. Also, the shapes and configurations of the links themselves may vary, as will be understood by those skilled in this art. Further, some links may be omitted entirely in some embodiments, and additional links may be included in some embodiments.

Referring now to the drawings, a chair, designated broadly at 10, is illustrated in FIGS. 1-3H. The chair 10 includes a frame 12 that has legs 13, two arms 14 that are attached above the legs 13, a generally horizontal seat 22 that spans and is fixed relative to the arms 14, and a generally vertical backrest 28 that spans and is fixed relative to the arms 14 rearward of the arms 14. As used herein to describe the relative positions of components, the terms "lateral", "outward" and derivatives thereof indicate the directions defined by a vector beginning at a vertical plane that bisects the chair 10 normal to the seat 22 and the backrest 28 and extending normal thereto. Conversely, the terms "inward", "inboard" and derivatives thereof indicate the direction opposite the "outward" direction. Together, the "inward" and "outward" directions comprise the "transverse" axis of the chair 10. The "rear" of the chair 10 is located at the tip of the backrest 28, and the "front" of the chair 10 is located at the end of the seat 22 farthest from the backrest 28. The "front" and "rear" directions comprise the "longitudinal" axis of the chair 10.

Figure 2:
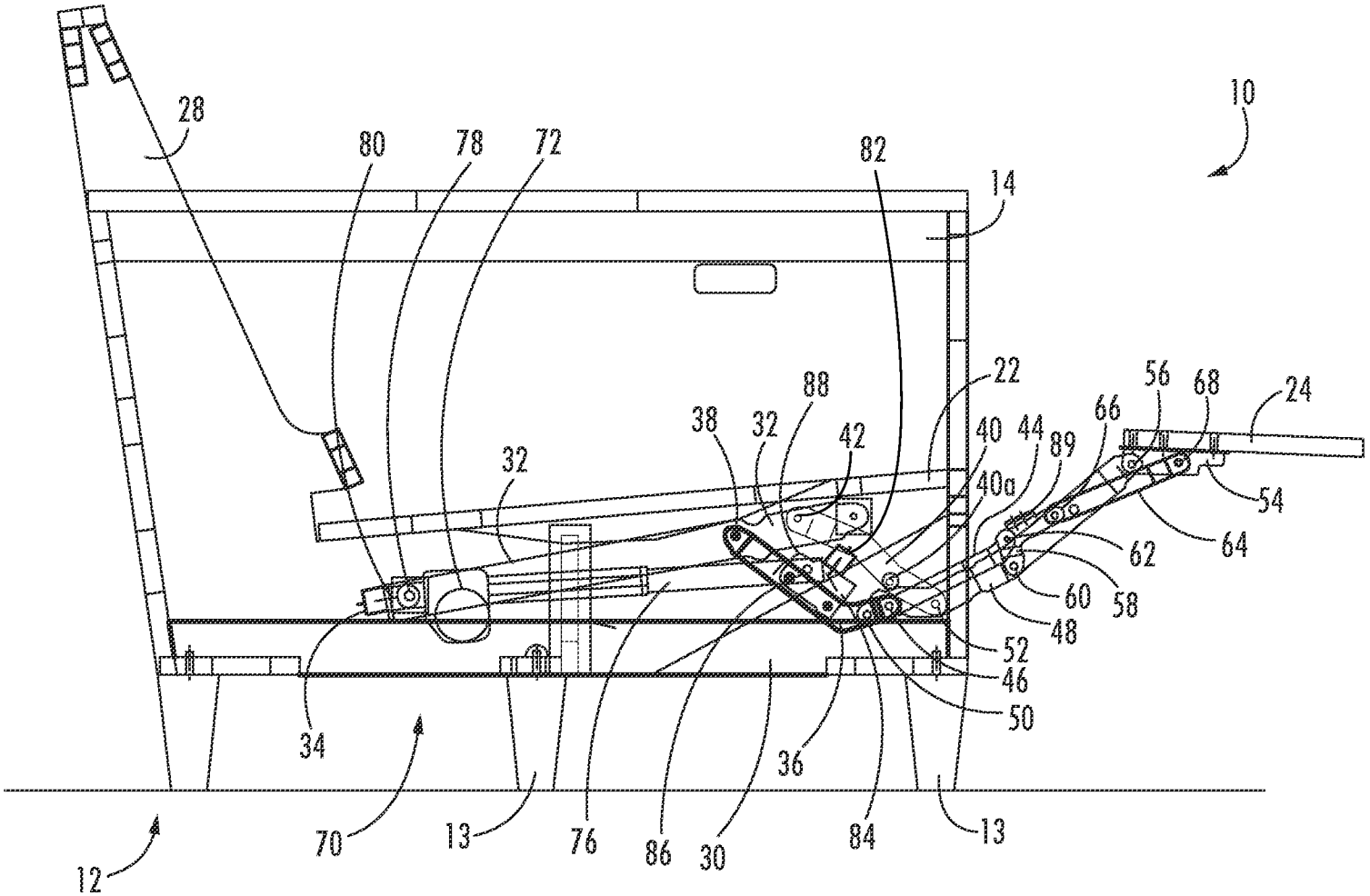
FIG. 2 is a side view of the chair of FIG. 1 with the footrest in an extended position.
Figure 3A:
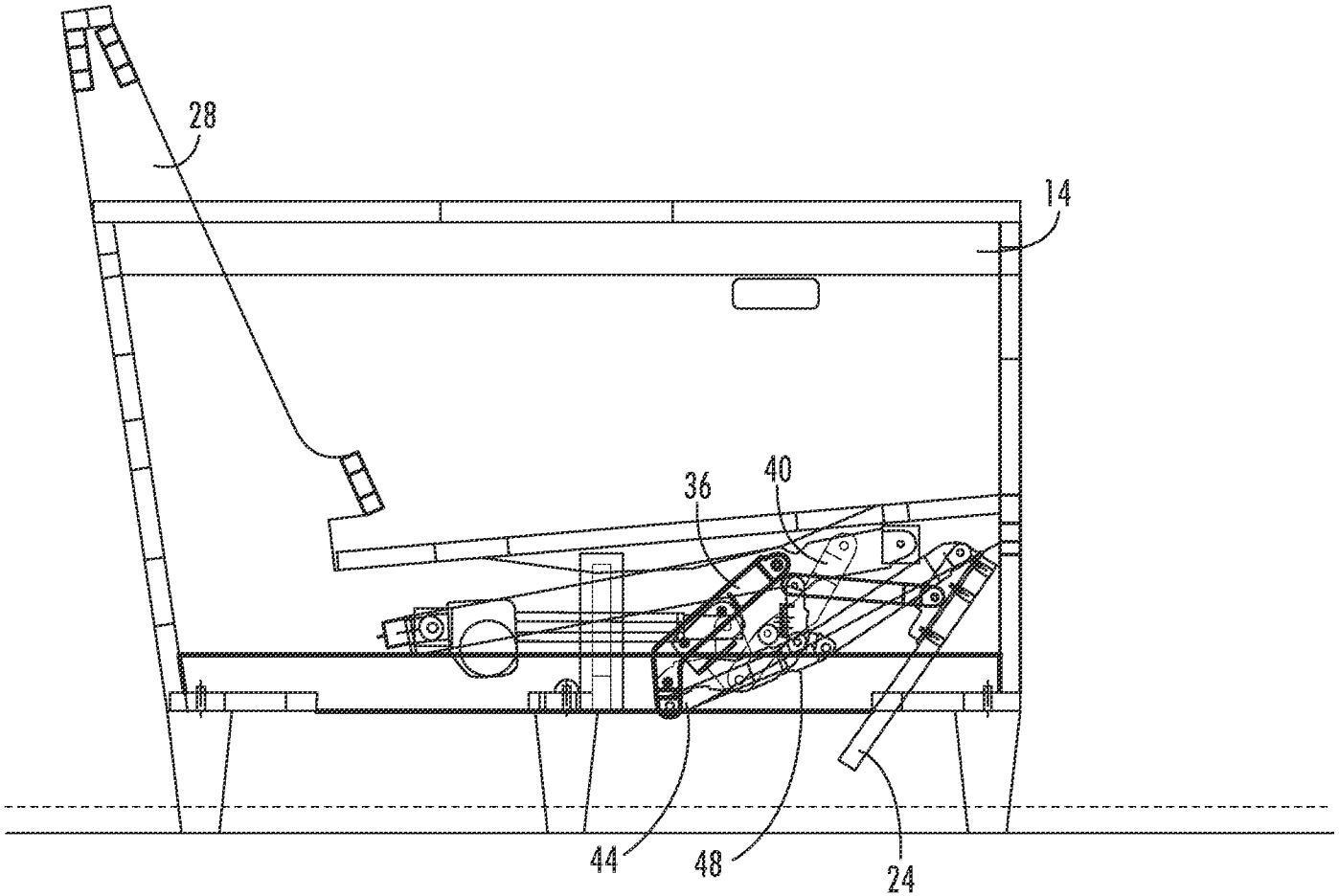
FIGS. 3A-3H are enlarged sequential views of the footrest mechanism of the chair of FIG. 1 showing the movement of the footrest as it travels from the retracted position to the extended position.
Figure 3B:
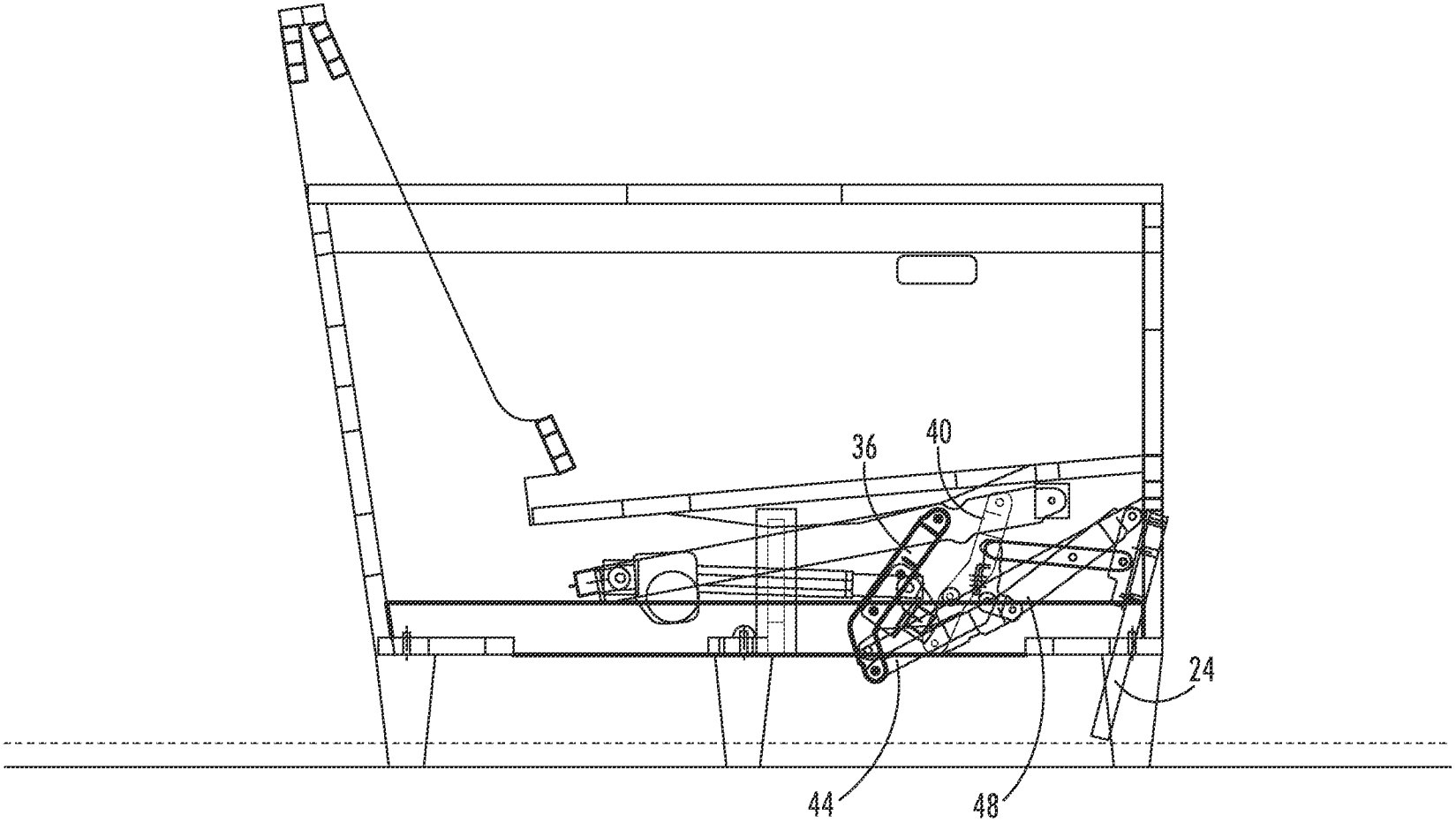
Figure 3C:
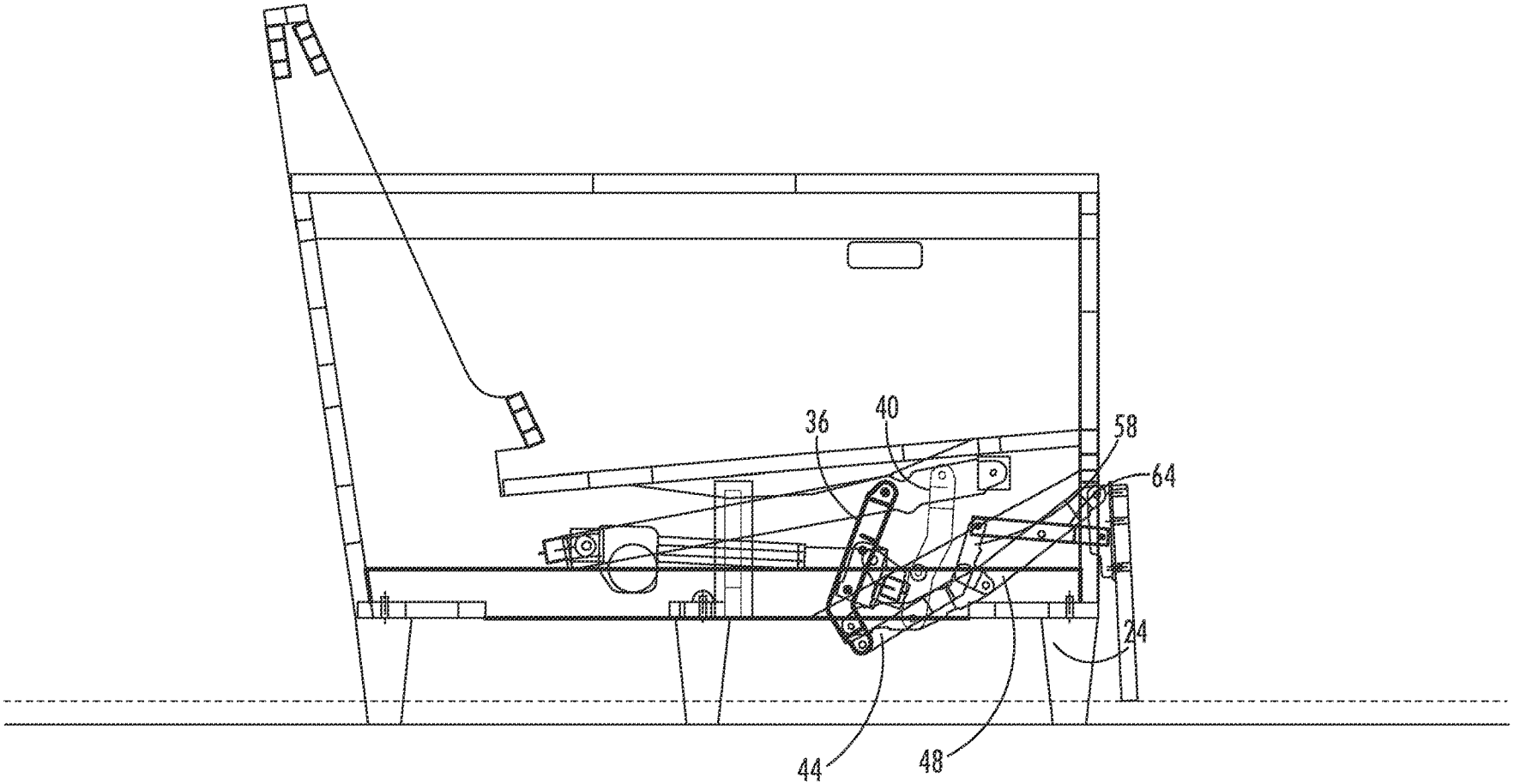
Figure 3D:
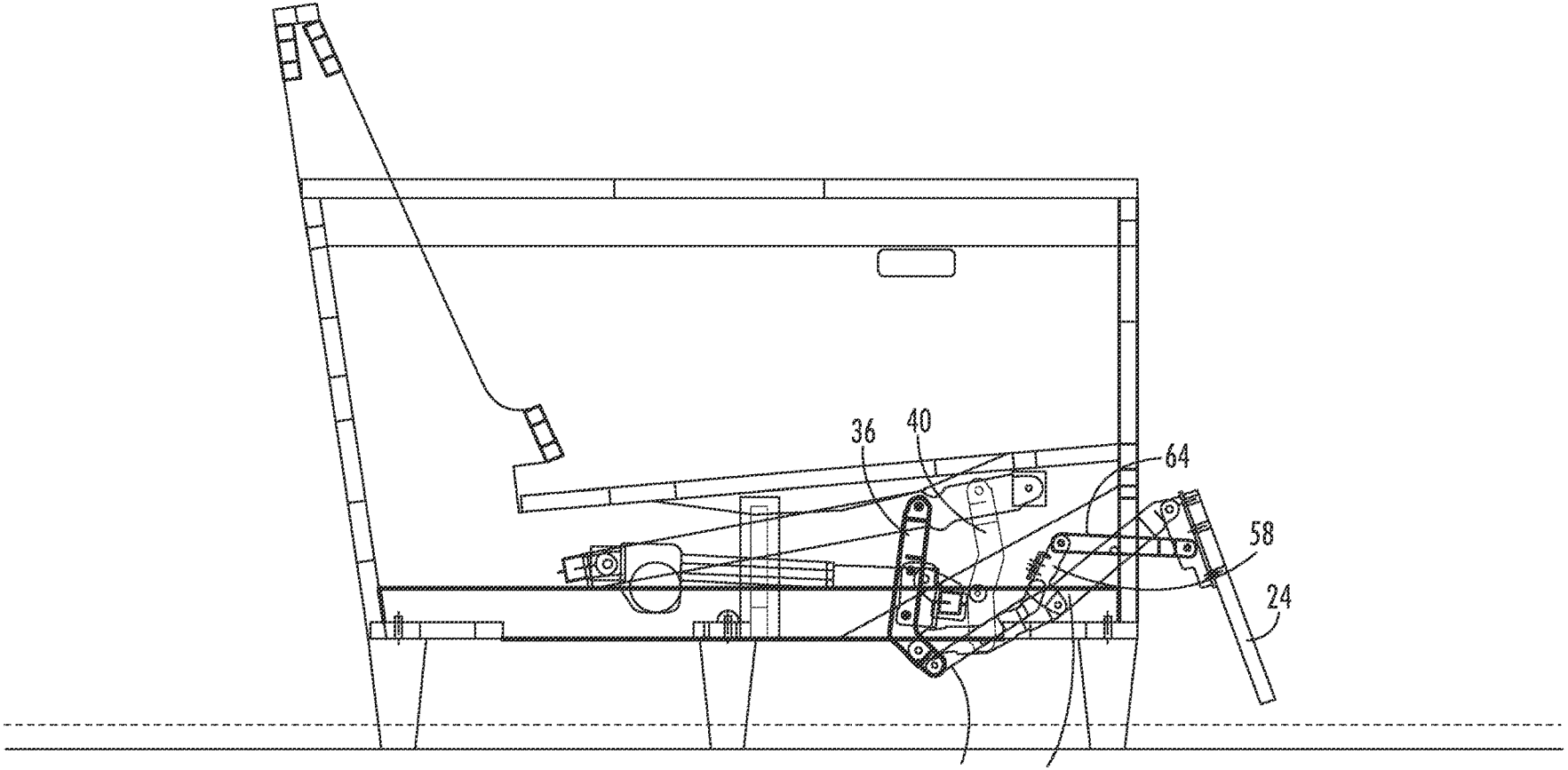
Figure 3E:
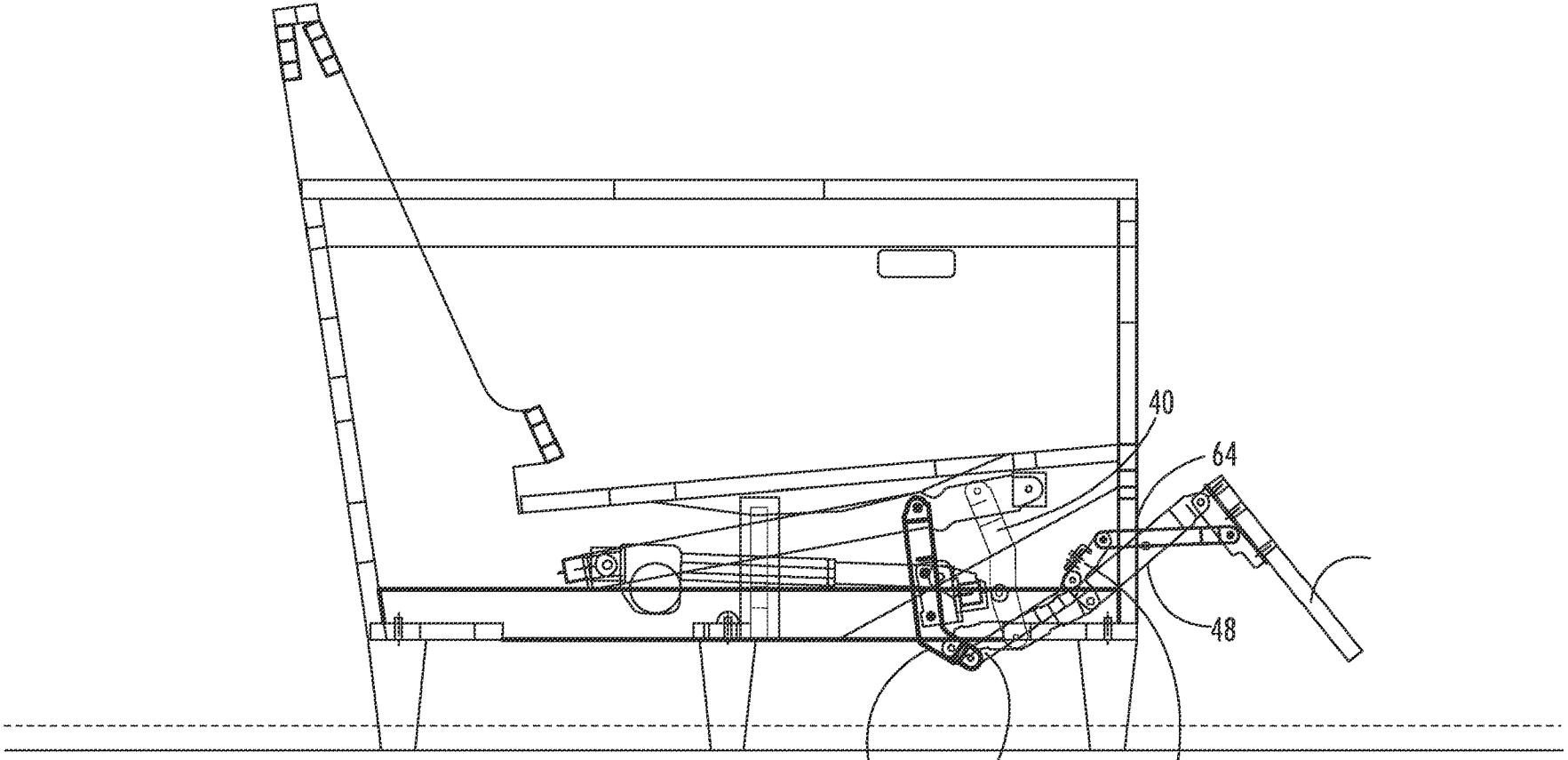
Figure 3F:
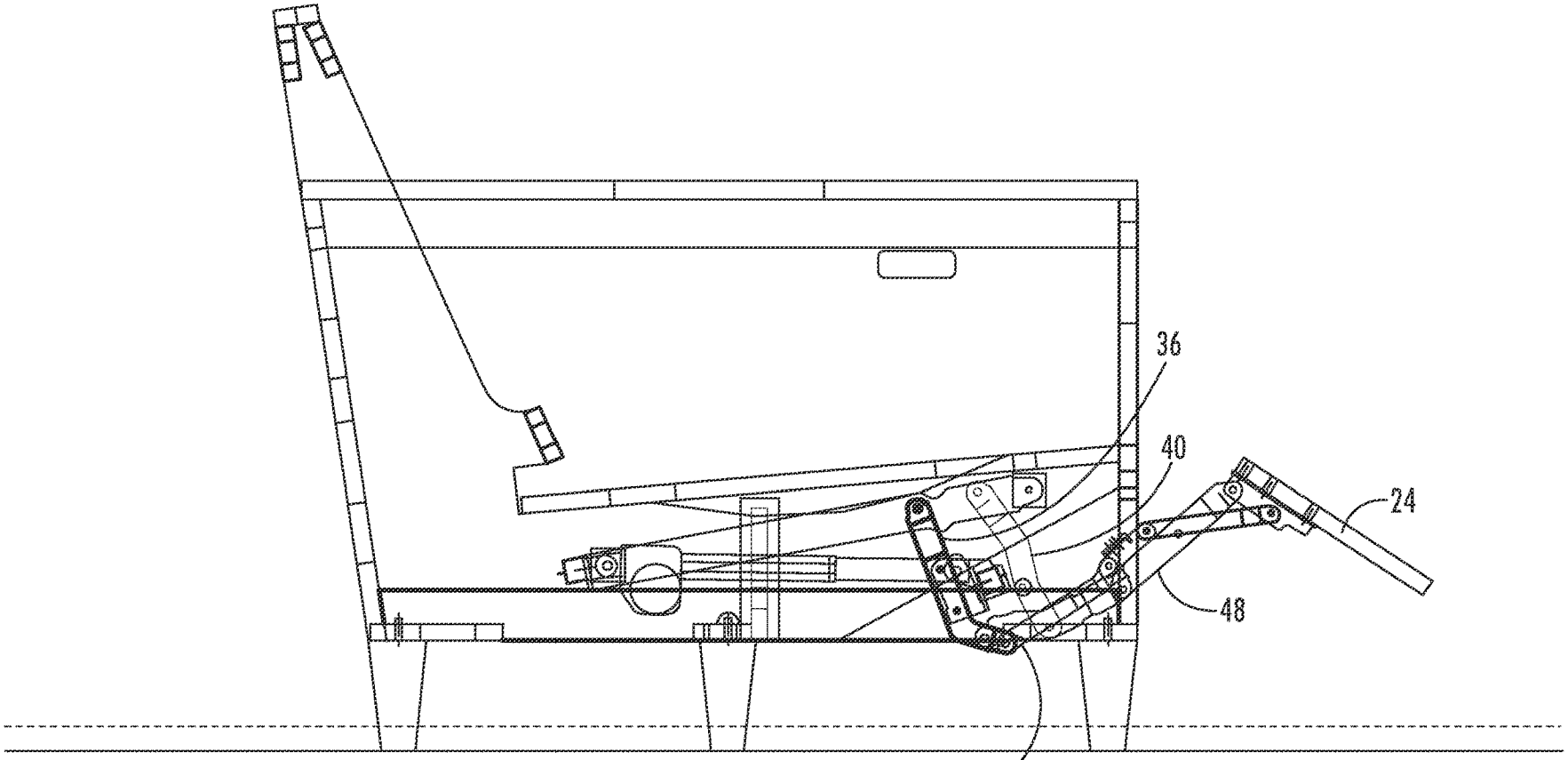
Figure 3G:
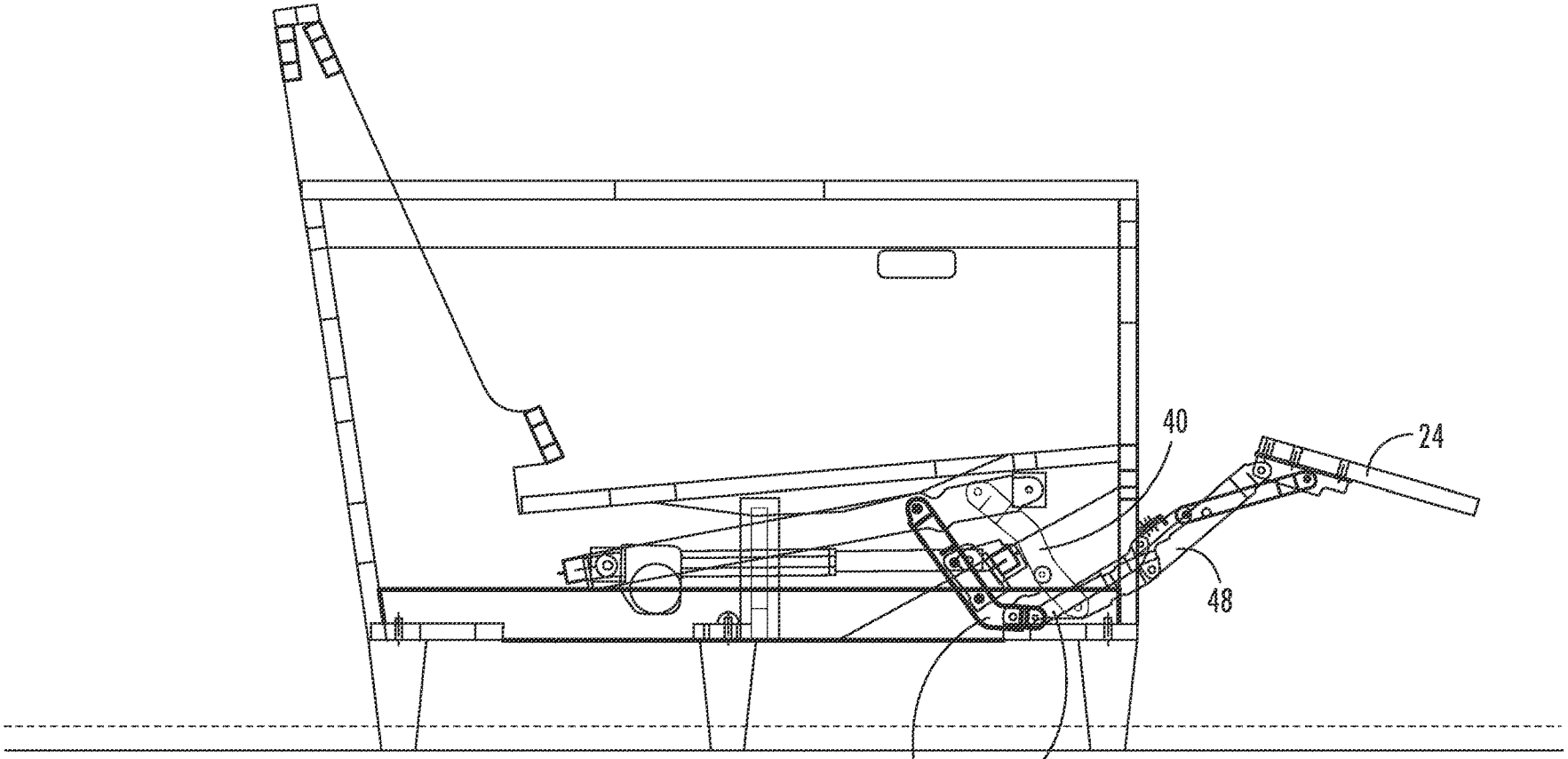
Figure 3H:
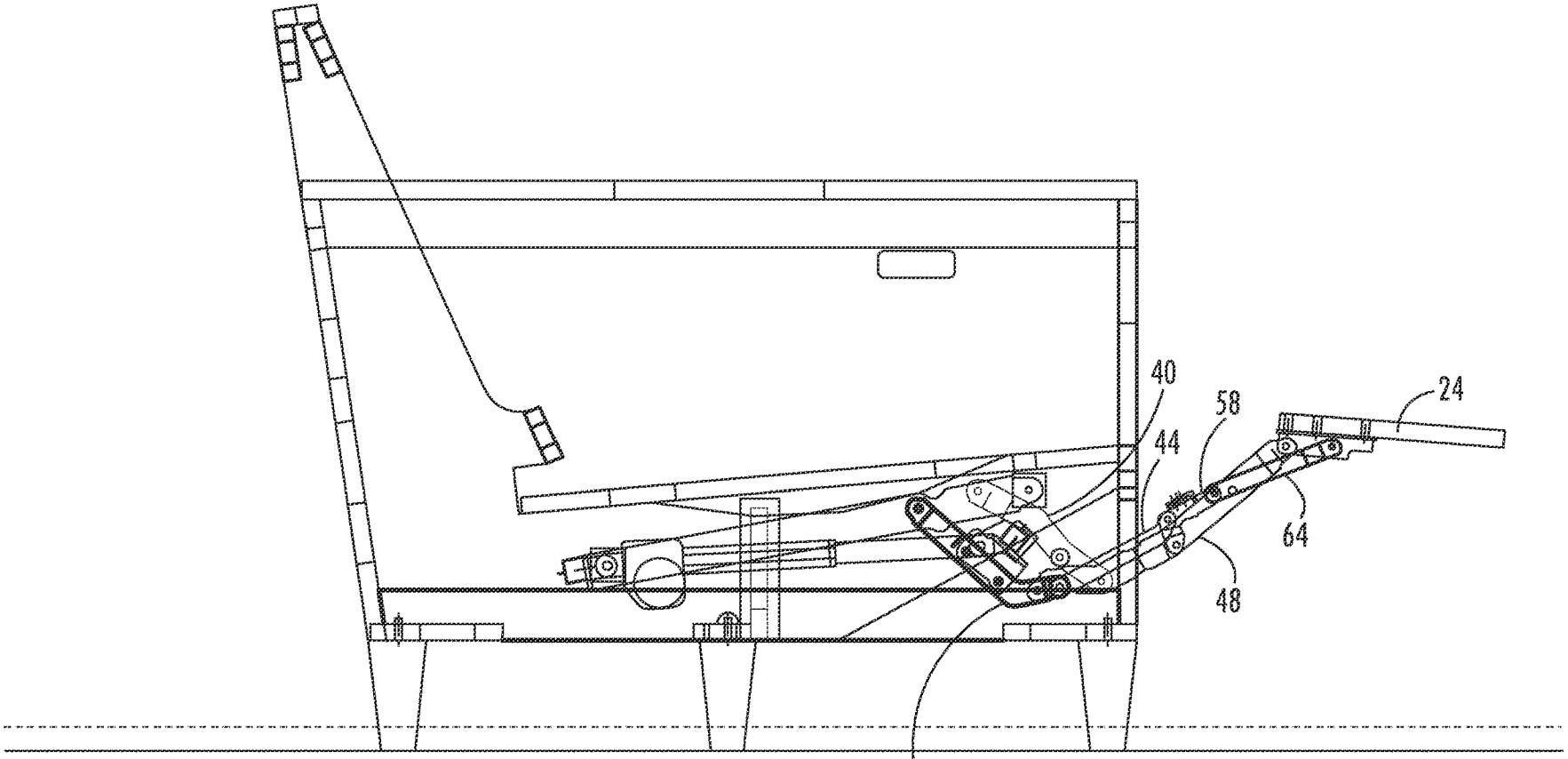

As can be seen in FIGS. 1 and 2, the chair 10 includes a footrest 24. The footrest 24 is moveable between a retracted position (FIG. 1), in which the footrest 24 is positioned beneath the seat 22 and is generally horizontally disposed, and an extended position (FIG. 2), in Which the footrest 24 is positioned in front of the seat 22 and is generally horizontally disposed and inverted from its disposition in the retracted position. Movement of the footrest 24 is controlled by two footrest mechanisms 30, which are described in greater detail below. The footrest mechanisms 30 are mirror images of one another about the aforementioned bisecting plane; as such, only one footrest mechanism 30 is described herein, with the understanding that this discussion is equally applicable to the footrest mechanism 30 on the opposite side of the chair 10. Also, for clarity the footrest mechanism 30 will be described first with respect to FIG. 2, wherein the footrest 24 is in the extended position; its deployment in and movement from the retracted position (FIG. 1) will then follow.

As seen in FIG. 2, the footrest mechanism 30 has a foundation link 32 that is mounted to the inner surface of the arm 22 (in some instances, the foundation link 32 is fixed to the inner surface of the arm 22 via spacers). A cross-member 34 is attached to the rear ends of the foundation links 32. An angled lower footrest swing link 36 is attached to a forward portion of the foundation link 32 at a pivot 38 and extends downwardly and forwardly therefrom. Similarly, an upper footrest swing link 40 is attached near the front end of the foundation link 32 at a pivot 42 and extends forwardly and downwardly therefrom. An upper footrest extension link 44 is attached to the front end of the lower footrest swing link 36 at a pivot 46 and extends forwardly and slightly upwardly therefrom. A lower footrest extension link 48 is attached to the lower footrest swing link 36 at a pivot 50 that is located slightly rearwardly of the pivot 46 and extends generally parallel with, but slightly below, the upper footrest extension link 40. The lower footrest extension link 48 is also attached to the lower end of the upper footrest swing link 40 at a pivot 52.

The lower footrest extension link 48 is attached at a pivot 56 to a footrest mounting bracket 54 on which the footrest 24 is mounted. An angled crank 58 is attached at its lower end to the lower footrest extension link 48 at a pivot 60, and at its vertex to the forward end of the upper footrest extension link 44 at a pivot 62. The forward end of the crank 58 is attached to a bracing link 64 at a pivot 66; the bracing link 64 also attaches to the footrest mounting bracket 54 at a pivot 68 that is forward of the pivot 56. It can be seen in FIG. 2 that the footrest 24 extends considerably in front of the footrest mounting bracket 54, typically this distance is between about 4 and 7 inches. In some embodiments, the footrest 24 itself is between about 8 and 12 inches in depth (often about 9.5 and 10.5 inches), such that in the extended portion the forward end of the footrest 24 is between about 15 and 20 inches in front of the front edge of the seat 22.

The chair 10 includes an actuating unit 70 that has a motor 72, a sleeve 74 attached to the motor 72 and extending forwardly therefrom, and a rod 76 that retracts within and extends from the sleeve 74. The motor 72 is attached at a pivot 78 to a small bracket 80 that is, fixed to the cross-member 34. Another cross-member 82 is fixed to and extends between brackets 84 that are fixed to the lower footrest swing links 36. The front end of the rod 76 is attached at a pivot 86 to a bracket 88 that is fixed on the cross-member 82. Another cross-member 89 extends between the cranks 58.

As can be seen in FIG. 1, when the footrest 24 is in the retracted position, the rod 76 is largely retracted within the sleeve 74. Both the lower footrest swing link 36 and the upper footrest swing link 40 are pivoted relative to the foundation link 32 so that they extend downwardly and rearwardly from their respective pivots 38, 42. The upper and lower footrest extension links 44, 48 are generally parallel with each other rearwardly and above the footrest 24. As described above, the footrest 24 is generally horizontal (it forms an angle α of between about 20 and 40 degrees with the underlying surface on which the chair 10 rests), with the surface opposite the footrest mounting bracket 54 facing downwardly. As can be seen in FIG. 1, in the retracted position the lower edge of the footrest 24 is positioned well off of the ground, to the point that it is obscured from view by the lower edge of the arms 14. In some embodiments, the lower edge of the footrest 24 is at least 4.5 and 6.5 inches above the underlying surface.

To move the footrest 24 from the retracted position of FIG. 1 to the extended position of FIG. 2, the occupant of the chair activates the actuating unit 70. Often the actuating unit 70 may be activated via one or more buttons, switches, toggles, or the like that are attached to the chair 10 and within easy reach of the occupant (for example, buttons may be mounted on the inside or outside of one of the arms 14, or mounted as part of a console or handheld remote control device). Such buttons, switches, etc., are operatively connected with the motor 72 (e.g., they may be hard-wired or wireless) to cause the motor 72 to operate. As the motor 72 drives the rod 76 from the sleeve 74, forward movement of the rod 76 pushes the cross-member 82 forwardly, which in turn causes the lower footrest swing link 36 to pivot counterclockwise (from the vantage point of FIGS. 1 and 2) about the pivot 38. Such rotation forces the lower footrest extension link 48 forwardly and slightly upwardly, which rotates the upper footrest swing link 40 counterclockwise about the pivot 42. Rotation of the lower footrest swing link 36 also drives the upper footrest extension link 44 forwardly and slightly upwardly. In moving forwardly, the lower footrest extension link 48 descends slightly relative to the upper footrest extension link 44, with the result that the crank 58 rotates clockwise about the pivot 60. Rotation of the crank 58 forces the bracing link 64 forwardly relative to the lower footrest extension link 48. This relative movement causes the footrest 24 to invert itself (i.e., it rotates between about 140 to 160 degrees counterclockwise) to a position well in front of the seat 22 in which it is generally horizontally disposed. Movement ceases when the upper edge of the lower footrest extension link 48 contacts a stop pin 40*a* on the upper footrest swing link 40.

Those of skill in this art will appreciate that one of the obstacles to designing a chair with a "tuck-under" footrest such as that depicted therein is creating a design in which (a) the footrest 24 is not visible from the side when the footrest 24 is retracted, and (b) the footrest 24 is deployed at a distance in front of the seat 22 providing adequate support for the occupant's legs, while (c) the footrest 24 does not strike the underlying surface while being extended. Prior seating units, such as those discussed in U.S. Pat. No. 8,714,638 to Hoffman et al., rely at least partially on movement of the seat relative to the arms to provide room below the seat for the footrest to swing downwardly in moving to the extended position; more specifically, in the prior chairs the seat increases in pitch angle, the front end of the seat rises, and the seat moves rearwardly relative to the frame in order to provide room for the footrest to swing downward and forward on its way to the fully extended position.

The desired motion of the footrest 24 can be achieved in the footrest mechanism 30 via redesigning of the links thereof. As one example, in the footrest mechanism 30, the distance between the pivots 42, 52 of the upper footrest swing link 40 are slightly farther apart from each other that are the pivots 38, 50 of the lower footrest swing link 36 (e.g., between 1 and 5 percent). This arrangement causes the lower footrest extension link 48 to delay its rotation slightly, and to accelerate its forward movement. This accelerated movement allows the upper end of the footrest 24 to clear the front end of the seat 22 even though the footrest 24 has rotated significantly. The motion of the footrest 24 throughout its movement to the extended position can be seen in FIGS. 3A-3H.

Figure 4:
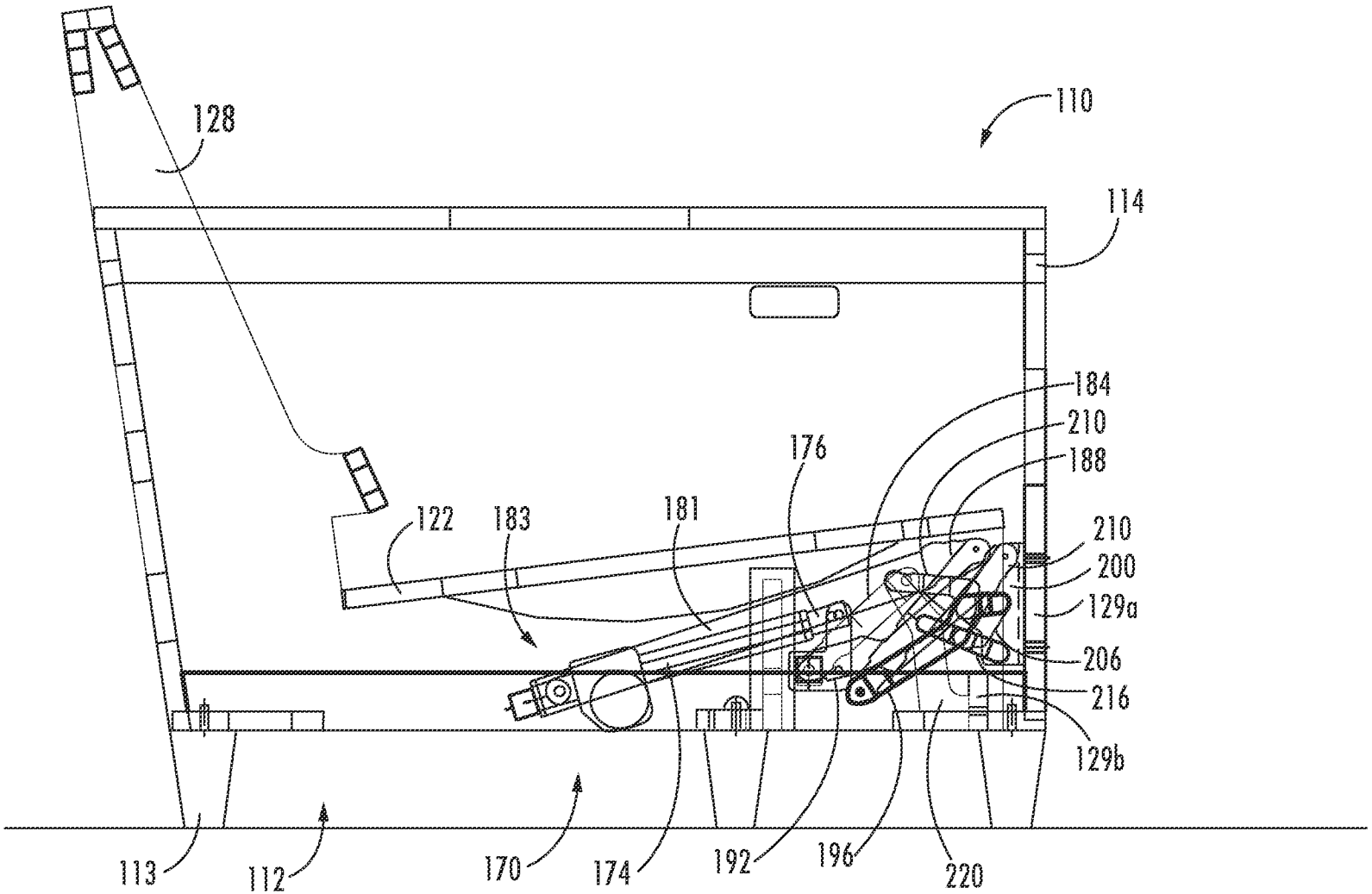
FIG. 4 is a side view of a chair with an extendable footrest according to another embodiment of the invention, wherein the footrest is in its retracted position.
Figure 5:
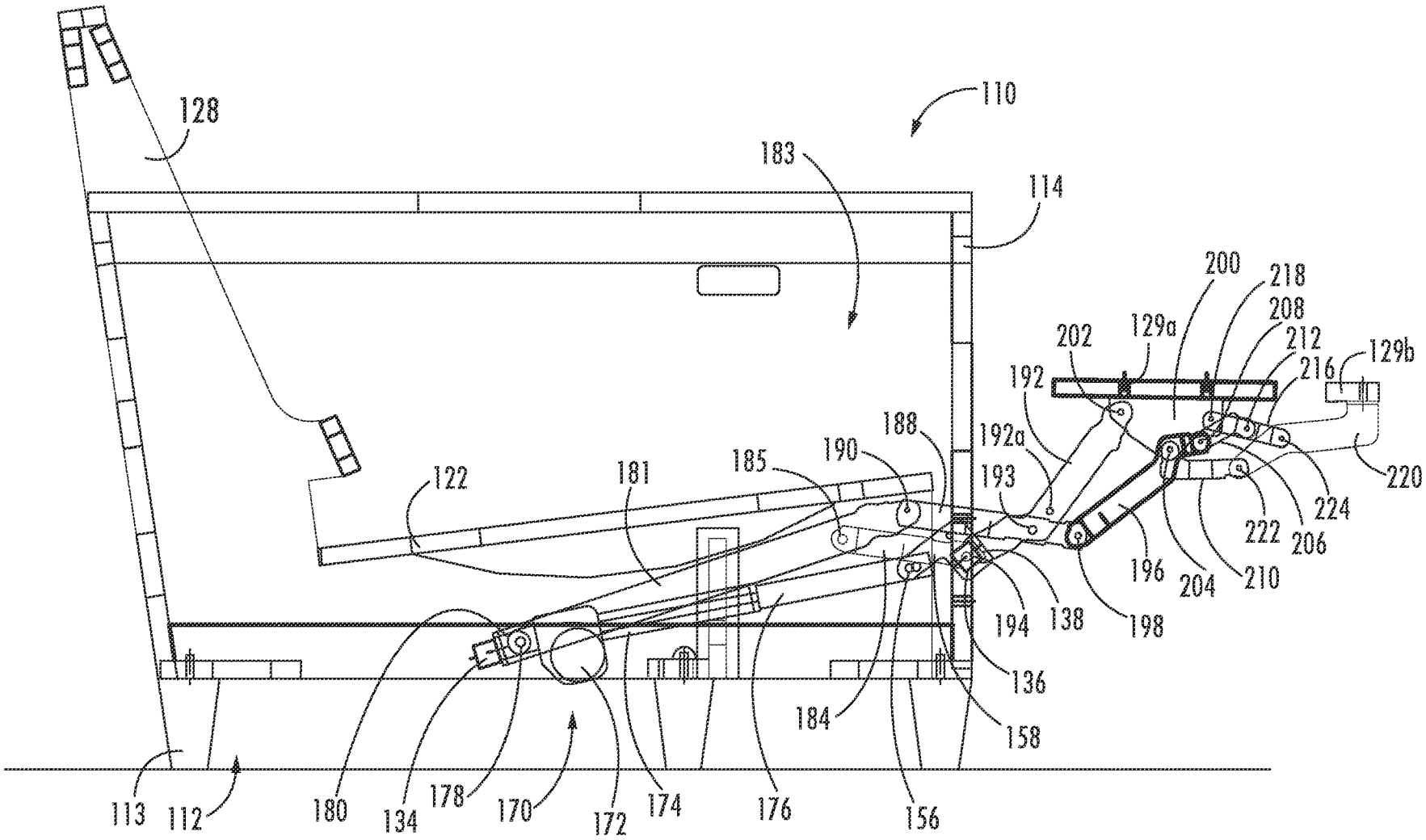
FIG. 5 is a side view of the chair of FIG. 4 with the footrest in an extended position.

Referring now to FIGS. 4 and 5, another chair, designated broadly at 110, is shown therein. The chair 10 includes a frame 112 that has legs 113, two arms 114 that are attached above the legs 113, a generally horizontal seat 122 that spans and is fixed relative to the arms 114, and a generally vertical backrest 128 that spans and is fixed relative to the arms 114 rearward of the arms 114. Main and auxiliary footrests 129*a*, 129*b* are moveable via a footrest mechanism 183 between (a) a retracted position (FIG. 4), in which the footrest linkage 183 is folded under the front portion of the seat 122, with the main footrest 129*a* generally vertically disposed just forward of the seat 122, and the auxiliary footrest 129*b* disposed rearward of the main footrest 129*a*, and (h) an extended position, in which the main and auxiliary footrests 129*a*, 129*b* are extended in front of the seat 122 and are generally horizontally disposed, with the auxiliary footrest 129*b* positioned in front of the main footrest 129*a*.

For clarity the footrest mechanism 183 will be described first with respect to FIG. 5, wherein the footrests 129*a*, 129*b* are in the extended position; their movement to the retracted position (FIG. 4) will then follow.

The footrest linkage 183 has a foundation link 181. A lower footrest swing link 184 that is attached to the foundation link 181 at a pivot 185 and extends forwardly therefrom. An upper footrest swing link 188 is also attached to the seat 122 at a pivot 190 and extends forwardly therefrom. An upper footrest extension link 192 is attached to the forward end of the lower footrest swing link 184 at a pivot 194 and extends upwardly and forwardly therefrom. The upper footrest extension link 192 is also attached to the upper footrest swing link 188 at a pivot 193. A lower footrest extension link 196 is attached to the forward end of the upper footrest swing link 188 at a pivot 198 and extends forwardly and upwardly therefrom. A main footrest bracket 200 is attached to the forward ends of the upper footrest extension link 192 and the lower footrest extension link 196 at, respectively, pivots 202, 204. The main footrest 129*a* is mounted on the main footrest bracket 200 (FIG. 5).

A lower auxiliary footrest swing link 210 is attached to the main footrest bracket 200 at the pivot 204, and an upper auxiliary footrest swing link 216 is attached to the main footrest bracket 200 at a pivot 218. An auxiliary footrest bracket 220 is attached to the front ends of the swing links 210, 216 at, respectively, pivots 222, 224. A control link 206 is attached to the forward end of the lower footrest extension link 196 at a pivot 208 and to the upper auxiliary footrest swing link 216 at a pivot 212. The auxiliary footrest 129*b* is mounted on the auxiliary footrest bracket 220 (FIG. 5).

The chair 110 includes an actuating unit 170 that has a motor 172, a sleeve 174 attached to the motor 172 and extending forwardly therefrom, and a rod 176 that retracts within and extends from the sleeve 174. The motor 172 is attached at a pivot 178 to a small bracket 180 that is fixed to a cross-member 134 that spans the foundation links 181. Another cross-member 136 is fixed to and extends between brackets 138 that are fixed to the lower footrest swing links 184. The front end of the rod 176 is attached at a pivot 156 to a bracket 158 that is fixed on the cross-member 136.

Operation of the chair 110 typically commences with the footrests 129*a*, 129*b* in the retracted position of FIG. 4. In the retracted position, the footrest mechanism 183 is folded under the front portion of the seat 122, with the main footrest 129*a* generally vertically disposed just forward of the seat 122, and the auxiliary footrest 129*b* generally vertically disposed rearward of the main footrest 129*a*.

In some embodiments, the arrangement of the footrest mechanism 183 can enable the main and auxiliary footrests 129*a*, 129*b* to be the same (or nearly the same) width (e.g., substantially the full width of the chair 110). For example, the auxiliary footrest 129*b* may be nearly the same width (within 1-2 inches) as the main footrest 129*a*. This is due to the fact that, in the retracted position shown in FIG. 4, there are no links positioned directly in front of the auxiliary footrest 129*b* that could prevent it from traveling forwardly. This is in contrast to many prior chairs, in which the auxiliary footrest 129*b* is shorter in width than the main footrest 129*a* because links controlling the extension and retraction of the main footrest 129*a* are positioned directly in front of the auxiliary footrest 129*b* and therefore would interfere with its extension if the auxiliary footrest 129*b* were nearly as wide as the main footrest 129*a*.

To move the footrests 129*a*, 129*b* to the extended position of FIG. 5, the occupant of the chair 110 activates the actuating unit 170 as described above in connection with the chair 110. This action drives the rod 176 forwardly, which drives the cross-member 136 forwardly and causes the lower footrest swing link 184 to rotate counterclockwise about the pivot 185. The movement of the lower footrest swing link 184 drives the upper footrest extension link 192 forwardly, which in turn rotates the upper footrest swing link 188 about the pivot 190. Rotation of the upper footrest swing link 188 drives the lower footrest extension link 196 forwardly and causes it to separate slightly from the upper footrest extension link 192. The relative movement of the upper and lower footrest extension links 192, 196 rotates the main ottoman bracket 200 counterclockwise to a generally horizontal position. Relative rotation of the main ottoman bracket 200 and the lower footrest extension link 196 also forces the control link 206 away from the main footrest bracket 200, which extends the upper auxiliary footrest swing link 216 and, in turn, the auxiliary footrest bracket 220. Extension ceases when the upper footrest swing link 188 strikes a pin 192*a* on the upper footrest extension link 192. Additional aspects of the extension of the footrests 129*a*, 129*b* may be discussed in U.S. Pat. No. 8,752,890 to Murphy et al., the disclosure of which is hereby incorporated herein by reference in its entirety.

As discussed above, in prior chairs often the seat would move relative to the arms in order to allow for room below the seat and above the ground for the footrests to swing forward. Such movement is not necessary with the footrest mechanism 183.

It should be noted that, although the auxiliary footrest 129*b* is shown in a generally vertical disposition in the retracted position, in other embodiments the auxiliary footrest 129*b* may be disposed horizontally or at a different angle relative to horizontal. Further, in other embodiments the chair 110 may include a third footrest (for example, a footrest that is positioned between the main footrest 129*a* and the seat 122 in the extended position.

It should also be noted that both the footrest mechanism 30 and the footrest mechanism 183 are configured to be easily installed in a chair, love seat, sofa, or other seating unit. In each instance, the respective foundation links 32, 181 can simply be mounted to the arms of the seating unit. Thus, an existing stationary seating unit design may be easily converted to a unit with an extendable footrest with minimal modification.

Although the actuating units 70, 170 are illustrated herein, other actuating units, such as those employing a worm gear or screw and a traveling chassis may also be employed.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as recited in the claims. The invention is defined by the following claims, with equivalents of the claims to be included therein.

That which is claimed is:

1. A seating unit, comprising:

a frame configured to rest on an underlying surface comprising a pair of opposed arms, a seat fixed relative to the arms, and a backrest fixed relative to the arms;

a footrest; and a footrest mechanism attached to the footrest and the arms, the footrest mechanism comprising a plurality of pivotally interconnected links configured to move the footrest between a retracted position, in which the footrest is positioned beneath the seat and defines an angle of between about 20 and 40 degrees with the underlying surface, and an extended position, in which the footrest is positioned in front of the seat and is generally horizontally disposed and generally inverted from its disposition in the retracted position;

wherein the footrest has a depth measured in the longitudinal direction when the seating unit is in the extended position, and wherein the footrest maintains the depth as it moves between the retracted and extended positions.

2. The seating unit defined in claim 1, wherein the footrest mechanism includes a foundation link fixed to one of the arms.

3. The seating unit defined in claim 2, wherein the footrest mechanism further includes a lower footrest swing link pivotally attached to the foundation unit at a first pivot, an upper footrest swing link pivotally attached to the foundation unit at a second pivot, and a lower footrest extension link pivotally attached to the lower and upper footrest swing links at third and fourth pivots, respectively, and wherein a first distance between the first and third pivots is less than a second distance between the second and forth pivots.

4. The seating unit defined in claim 3, wherein the second distance is between about 1 and 10 percent greater than the first distance.

5. The seating unit defined in claim 1, wherein the depth of the footrest is between about 8 and 12 inches.

6. The seating unit defined in claim 1, wherein in the extended position, the footrest is positioned between about 4 and 7 inches from a frontmost portion of the seat.

7. The seating unit defined in claim 1, wherein in the retracted position, a lowermost portion of the footrest is between about 4.5 and 6.5 inches above the underlying surface.

8. The seating unit defined in claim 1, further comprising an actuating unit comprising a motor, a sleeve, and a rod, wherein the rod is pivotally attached to the footrest mechanism, such that retraction of the rod within the sleeve moves the footrest to the retracted position, and extension of the rod from within the sleeve moves the footrest to the extended position.

9. A seating unit, comprising:

a frame configured to rest on an underlying surface comprising a pair of opposed arms, a seat fixed relative to the arms, and a backrest fixed relative to the arms;

a footrest; and a footrest mechanism attached to the footrest and the arms, the footrest mechanism comprising a plurality of pivotally interconnected links configured to move the footrest between a retracted position, in which the footrest is positioned beneath the seat and defines an angle of between about 20 and 40 degrees with the underlying surface, and an extended position, in which the footrest is positioned in front of the seat and is generally horizontally disposed and generally inverted from its disposition in the retracted position;

wherein the footrest mechanism includes a foundation link fixed to one of the arms, a lower footrest swing link pivotally attached to the foundation unit at a first pivot, an upper footrest swing link pivotally attached to the foundation unit at a second pivot, and a lower footrest extension link pivotally attached to the lower and upper footrest swing links at third and fourth pivots, respectively, and wherein a first distance between the first and third pivots is less than a second distance between the second and forth pivots.

10. The seating unit defined in claim 9, wherein the second distance is between about 1 and 10 percent greater than the first distance.

* * * * *